US005864268A

United States Patent [19]

Hoffmann et al.

[11] Patent Number: 5,864,268

[45] Date of Patent: Jan. 26, 1999

[54] ELECTROMAGNETIC RELAY AND METHOD OF ADJUSTMENT OF A RESPONSE VOLTAGE THEREOF

[75] Inventors: Wolfgang Hoffmann; Andre Koerner; Maik Zimmer, all of Lippstadt, Germany

[73] Assignee: Hella KG Hueck & Co., Lippstadt, Germany

[21] Appl. No.: 754,112

[22] Filed: Nov. 22, 1996

[30] Foreign Application Priority Data

Nov. 30, 1995 [DE] Germany ..... 195 44 626.7

[51] Int. Cl.[6] ..... H01H 51/22

[52] U.S. Cl. ..... 335/78; 335/79; 335/80; 335/81; 335/82; 335/83; 335/84; 335/85; 335/86; 335/128

[58] Field of Search ..... 335/78–86, 128; 324/418

[56] References Cited

U.S. PATENT DOCUMENTS

| | | | |
|---|---|---|---|
| 4,910,484 | 3/1990 | Shikano et al. | 335/61 |
| 5,049,844 | 9/1991 | Mustafa | 335/76 |
| 5,155,458 | 10/1992 | Gamble | 335/80 |

FOREIGN PATENT DOCUMENTS

| | | |
|---|---|---|
| 1 816 364 | 7/1970 | Germany . |
| 32 35 714 A1 | 3/1984 | Germany . |
| 38 41 667 C1 | 2/1990 | Germany . |
| 43 26 362 A1 | 2/1994 | Germany . |
| 42 43 852 C1 | 3/1994 | Germany . |
| 42 43 854 C1 | 3/1994 | Germany . |

*Primary Examiner*—Michael L. Gellner
*Assistant Examiner*—Tuyen T. Nguyen
*Attorney, Agent, or Firm*—Griffin, Butler Whisenhunt & Szipl, LLP

[57] ABSTRACT

An electromagnetic relay constructed as a hinged-armature relay in which an armature (5) is attached to a flat-shaped spring (6) which spring is constructed as one piece to serve both as a switch-contact spring and as a return spring and which is mechanically and electrically coupled to a load-current terminal (11), with the load-current terminal having a spring affixing area **(11*a*) and a terminal area (11*b*), wherein the spring affixing area and the terminal area of the load-current terminal are bendable relative to one another. A response voltage of such a relay can be adjusted in a particularly uncomplicated and quick manner using a wedge-shaped adjusting tool (12)** to bend the affixing area relative to the terminal area.

8 Claims, 2 Drawing Sheets

ELECTROMAGNETIC RELAY AND METHOD OF ADJUSTMENT OF A RESPONSE VOLTAGE THEREOF

BACKGROUND OF THE INVENTION

This invention relates to an electromagnetic relay as well as to a process for adjusting a response voltage of the electromagnetic relay. Such a relay is disclosed in German Patent Document DE 42 43 852 wherein a process for adjusting a response voltage for a relay as is also disclosed in German Patent Document DE 42 43 854 is set forth.

In this relay, a switching contact spring has a spring coupling element which is shoved, by means an adjusting stamp, onto a portion of a terminal tongue until a relay armature is attracted, with a predetermined attraction voltage being applied. If this is successful, the coupling element is affixed to this portion of the terminal tongue by laser welding.

In this manner, a mounting step and an adjusting step are carried out at the same fabrication station, whereby, in a beneficial manner, one costly apparatus can be avoided; however, the apparatus for this combined mounting and adjusting step is in itself similarly expensive.

Under certain circumstances, however, it can also be convenient for the mounting and adjusting steps to be carried out one after the other; such as when large numbers of such relays must be fabricated and, accordingly, the fabrication cycle time must be quite small.

In this case, the mounting and adjusting will indeed require two apparatus instead of one, whereby, however, each of these apparatus can be of a less complicated structure than a known combined apparatus. The piece, or cycle, times are, however, significantly smaller, because the relatively time-intensive combined mounting and adjusting step is eliminated and is replaced by two extremely fast single steps carried out in series.

A process is previously disclosed in German Patent publication DE 32 35 714 A1 in which a response voltage of an already mounted relay can be adjusted. Here, it is suggested to deform relay components which can be deformed in a selective manner by means of local warming; that is, mainly, to deform a contact spring by means of a laser beam.

This process is quite expensive because not only is an expensive laser installation necessary but also a precisely functioning optical beaming device to control the laser beam; and, in order to control this aiming device an algorithmic correlation between an illuminated point, an illumination time period and a desired deformation for adjusting the component, must be exactly known.

Further, this laser adjustment produces a material deformity exactly at points on the contact spring that will be significantly loaded later during operation of the relay. Thus, this process can lead to a reduction in the lifetime and/or the reliability of a relay adjusted in this manner.

It is therefore an object of this invention to provide a relay which does not have the above mentioned disadvantages, that is uncomplicated and cost effective to mount and whose response voltage can also be adjusted in an uncomplicated and cost effective manner when already mounted.

SUMMARY OF THE INVENTION

According to principles of this invention, a spring-affixing area and an electrical-coupling area of a load-current terminal are structured to be bendable relative to one another.

BRIEF DESCRIPTION OF THE DRAWING

The invention is described and explained in more detail below using the embodiment shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
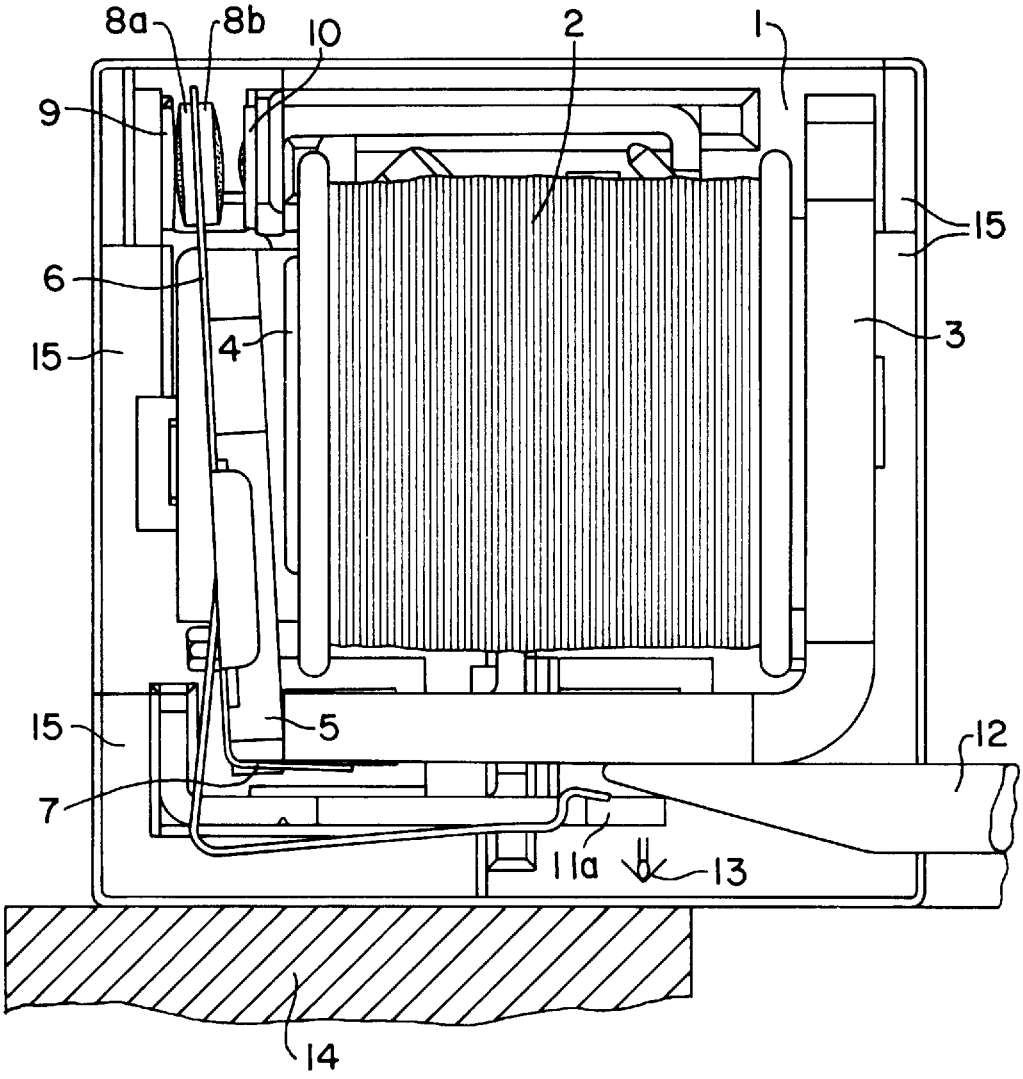
FIG. 1 is a plan top view of a relay of this invention before an adjustment thereof.

FIG. 1 shows a relay according to this invention immediately before an adjustment of its response voltage.

The relay comprises a ground plate 1 on which a magnet coil 2 is arranged. An approximately L-shaped yoke 3 lies about two sides of the magnet coil 2, and is riveted to a magnetic core 4.

A portion of an armature 5 lies on an edge surface of the yoke 2. The armature 5 is held by a flat-shaped spring 6, with which it is mechanically attached (in this exemplary embodiment it is riveted). Bent end portions 7 of the flat-shaped spring 6 prop, or support, the armature 5 against the yoke 3.

The flat-shaped spring 6 serves also as a switch-contact spring as well as a return spring for the armature 5. It, therefore, supports two switching contacts 8*a*, 8*b*, of which one 8*a* lies against a break contact 9 with the other 8*b* being opposite the make contact 10.

The plug terminals that are coupled to the contacts 8*a*, 8*b*, 9, 10 are not recognizable in FIG. 1 because they are formed as flat plugs which extend through the not seen side of the ground plate 1.

Only a portion of the load-current terminal, which is electrically and mechanically coupled to the switch-contact spring (formed by the flat-shaped spring 6) can be seen, with this portion being identified here as a spring-affixing area 11*a*. The load-current terminal will be described in more detail below relative to FIG. 2.

It is significant that a bias of the return spring (which is also formed by the flat-shaped spring 6) of a relay according to this invention, changes if the spring affixing area 11*a* is pushed, or displaced. This happens here by bending the spring affixing area 11*a* by means of an adjusting stamp, or tool, 12. If, for example, the spring affixing area 11*a* is bent in the direction of an arrow 13 (FIG. 1.), the return force of the flat-shaped spring 6 applied to the armature 5 will be reduced and a necessary minimum response voltage is thereby also decreased.

The actual adjustment process takes place as follows: the relay lies against a frame 14 which provides a mechanical fixing and it is held thereto by means of a mechanical fixing device 15.

A predetermined response voltage is applied to the relay coil (not shown in the drawing), and the power terminals, which are coupled with the switch-contact spring (flat-shaped spring 6) and the working contact 10, are coupled with a current or resistance measuring apparatus which registers when the switching contact 8*b* lies against the make contact 10 and thus a successful operation of the relay has taken place.

By means of the wedge-shaped adjusting stamp 12, the spring affixing area 11*a* is bent until, because of a reducing bias of the flat-shaped spring 6, the relay operates.

This adjustment process can be carried out in a fully automatic and very fast operation so that it is suitable for adjustments of relays produced in high numbers, because the station time for relay production is not thereby increased.

Figure 2:
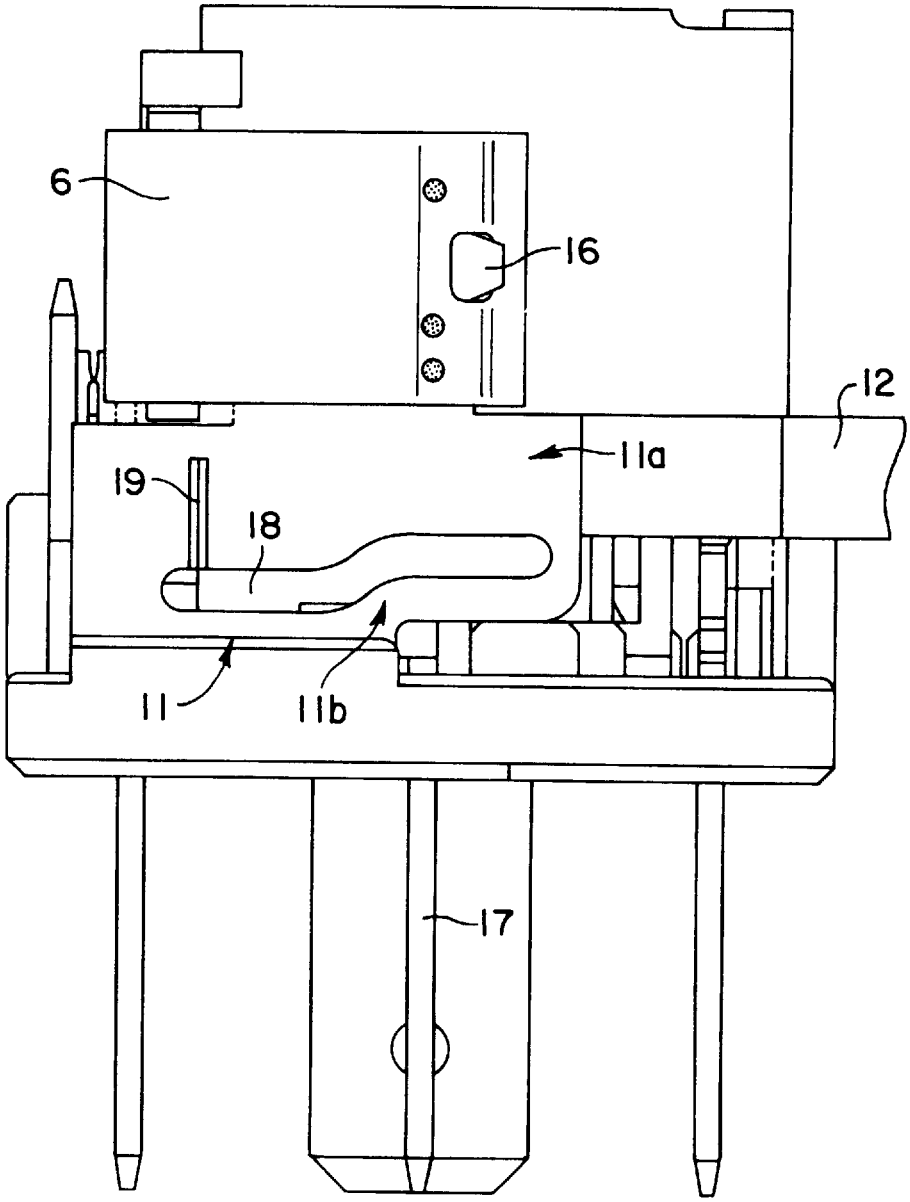
FIG. 2 is a side view of the relay of FIG. 1.

FIG. 2 makes clear, by means of another view, the structure of the relay according to this invention and shows further beneficial features.

Particularly clear here is the arrangement of the load-current terminal 11. At an upper area (spring affixing area 11*a*) the flat-shaped spring 6 is fixedly attached to the load-current terminal 11, indeed by means of a solder or weld coupling 16. At a lower area (terminal area 11*b*) the load-current terminal 11 forms a flat-plug 17.

The spring affixing area 11*a* and the terminal area 11*b* are separated from one another by a slit-shaped cutout 18, which simplifies the bending of the spring affixing area 11*a* by the adjusting stamp 12. An impression, or indentation, 19 serves as a desired bending position and provides therefore, that the bend takes place in a defined manner. The formation of the slit as an enclosed slit allows only a small spring back upon bending the load-current terminal 11.

In the embodiment of the electromagnetic relay of this invention, a bias of the flat-shaped spring, and thereby a strength of a return spring force on the armature, can be changed in a beneficial manner by a simple bend in the spring affixing area relative to the terminal area of the load-current terminal, whereby the response voltage can be influenced in an uncomplicated manner.

In beneficial embodiments the terminal area of the load-current terminal is made as a flat plug.

It is particularly beneficial that between the terminal area and the spring affixing area of the load-current terminal a cutout is provided in the shape of a slit whereby these areas move easily relative to one another.

Also, it is quite beneficial to make an indentation at a desired bending position in the load-current terminal so that the bend takes place exactly along a defined direction.

In a process to adjust the response voltage it is particularly beneficial that this method is technically so uncomplicated, that the adjusting takes place quite quickly and that the adjustment can be made on already mounted relays.

It is also beneficial that after the adjustment of the relay it is guaranteed that the relay operates at a predetermined response voltage. Because of this, a tolerance range of response voltages for all fabricated relays of one type can be substantially reduced. A type of modification of the fabrication apparatus, with a corresponding change in the response voltage, can be achieved by simply changing the excitation voltage applied to the relay spool for the adjustment.

Also, the adjustment apparatus itself can be rather uncomplicated in structure. The bending of the spring affixing area relative to the terminal area is carried out in an uncomplicated manner by using a wedge-shape adjusting stamp, or tool, which carries out a rotation.

While the invention has been particularly shown and described with reference to a preferred embodiment, it will be understood by those of ordinary skill in the art that various changes in form and detail may be made therein without departing from the spirit and scope of the invention.

The invention claimed is:

1. Electromagnetic relay constructed as a hinged armature relay comprising:

a coil;

an armature for being attracted by said coil;

a load current terminal having a fixed position relative to said coil during normal operation of said relay;

a flat-formed spring formed as a separate piece from said load current terminal, which spring is constructed as one piece to serve as both a switch-contact spring and as a return spring and which is mechanically and electrically coupled to the load-current terminal, said armature being attached to said flat-formed spring for causing said spring to move relative to said coil in response to said coil being energized;

wherein the load current-terminal has a spring affixing area to which said flat-formed spring is attached and a terminal area for receiving electrical energy and conducting it to said flat formed spring, and wherein the spring affixing area and the terminal area of the load-current terminal are structured to be bendable relative to one another for adjusting a response voltage of the electromagnetic relay.

2. Electromagnetic relay as in claim 1 wherein the terminal area includes a flat plug.

3. Electromagnetic relay as in claim 1 wherein the spring affixing area has an indentation to promote bending thereof.

4. Electromagnetic relay as in claim 1 wherein the load-current terminal has a slit-shaped cutout between the spring affixing area and the terminal area for promoting relative bending therebetween.

5. Process for adjusting a response voltage of the electromagnet relay of claim 1, wherein the process includes the steps:

holding the electromagnetic relay fixed to a frame;

applying a previously determined response voltage to terminals of the coil of the relay and measuring a current at terminals of a make contact of the relay and the flat formed spring; and with an adjusting tool, bending the affixing area of the load-current terminal relative to the terminal area so that the coil sufficiently attracts to thereby move the armature to electrically couple a switching contact on the switch-contact spring with the make contact.

6. Process as in claim 5 wherein the adjusting tool has a wedge-shape.

7. Process as in claim 5 wherein the adjusting tool is manipulated to cause a rotational movement of said affixing area about an axis of rotation which lies approximately along an elongated indentation in said load-current terminal.

8. Electromagnetic relay constructed as a hinged armature relay comprising:

an armature;

a load current terminal;

a flat-formed spring, which spring is constructed as one piece to serve as both a switch-contact spring and as a return spring and which is mechanically and electrically coupled to the load-current terminal, said armature being attached to said flat-formed spring;

wherein the load current-terminal has a spring affixing area to which said flat-formed spring is attached and a terminal area for receiving electrical energy and conducting it to said flat formed spring, and wherein the spring affixing area and the terminal area of the load-current terminal are structured to be bendable relative to one another for adjusting a response voltage of the electromagnetic relay;

wherein the spring affixing area has an indentation to promote bending thereof.

* * * * *